United States Patent [19]

Tazaki

[11] Patent Number: 4,518,973

[45] Date of Patent: May 21, 1985

[54] INK JET PRINTER VACUUM PURGING SYSTEM

[75] Inventor: Shigemitsu Tazaki, Matsudo, Japan

[73] Assignee: Canon Kabushiki Kaisha, Tokyo, Japan

[21] Appl. No.: 491,301

[22] Filed: May 3, 1983

[30] Foreign Application Priority Data

May 11, 1982 [JP] Japan ..... 57-77547

[51] Int. Cl.[3] ..... E01D 15/18

[52] U.S. Cl. ..... 346/140 R; 346/75

[58] Field of Search ..... 346/75, 140 R

[56] References Cited

U.S. PATENT DOCUMENTS 4,050,078 9/1977 Isayama et al. ..... 346/140 R 4,296,418 10/1981 Yamazaki et al. ..... 346/75 X 4,301,460 11/1981 Miura et al. ..... 346/140 R 4,362,572 12/1982 Wallace ..... 134/18 X

*Primary Examiner*—Thomas H. Tarcza

*Assistant Examiner*—Gerald E. Preston

*Attorney, Agent, or Firm*—Fitzpatrick, Cella, Harper & Scinto

[57] ABSTRACT

An ink jet printer comprises a recording head for discharging ink from an end thereof, a capping unit for releasably sealing the end of the recording head, a suction unit for sucking the end of the recording head by a negative pressure and an indication unit for indicating that a suction recovery operation is in progress until the negative pressure of the suction unit reaches a predetermined level.

11 Claims, 5 Drawing Figures

INK JET PRINTER VACUUM PURGING SYSTEM

BACKGROUND OF THE INVENTION

1. Field of the Invention

The present invention relates to an ink jet printer which prints characters by reciprocating a carriage, and more particularly to an ink jet printer which has a high operability in a suction recovery operation carried out when ink is not discharged or is discharged imperfectly.

2. Description of the Prior Art

In a prior art ink jet printer, imperfect printing frequently by non-discharge of ink, satellite or splash due to the effects of change of temperature, humidity or pressure, introduction of air bubbles into a nozzle or deposition of fine dust.

In such a case, the carriage is stopped to carry out the suction recovery operation in order to retain normal ink in the nozzle so that normal printing may be carried out by the normal ink. If the suction recovery operation is not properly carried out, the maintenance and reliability of the ink jet printer are degraded.

SUMMARY OF THE INVENTION

It is an object of the present invention to provide an ink jet printer which assures the suction recovery operation when imperfect printing occurs.

It is another object of the present invention to provide an ink jet printer which assures the suction recovery operation by detecting when the suction recovery operation is in process.

It is another object of the present invention to provide an ink jet printer which shares a portion of means for detecting the suction recovery operation with other detecting means to simplify a construction.

It is a further object of the present invention to provide an ink jet printer which determines the time required to complete the suction recovery operation.

Those and other objects of the present invention will be apparent from the following description of the invention.

DETAILED DESCRIPTION OF THE PREFERRED EMBODIMENTS

Figure 1:
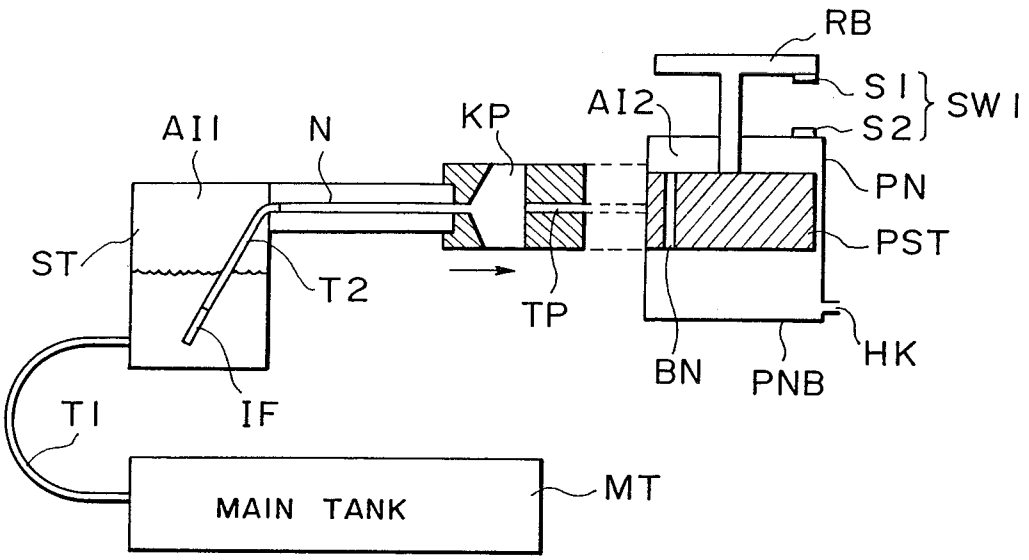
FIG. 1 shows a schematic construction of an ink supply mechanism and a suction recovery mechanism of an ink jet printer in accordance with the present invention.

FIG. 1 shows an embodiment of the ink jet printer of the present invention. Ink is supplied from a main ink tank MT to a sub-tank ST mounted on a carriage through a supply tube T1, and the ink is introduced into a nozzle N through a supply tube T2 having a filter 1F by a capillary attraction. The subtank ST including the nozzle N thus forms a serial recording head. The capillary attraction of the nozzle N is utilized becouse diameters of the supply tube T2 and the nozzle N are small. The sub-tank ST and the main tank MT are of sealed structure and the amount of ink discharged from the nozzle N is supplied by the main tank MT. The pressure created by centrifugal motion of the supply tube T1 acts as a supply pressure to the sub-tank ST to supply the ink. Air in the sub-tank ST acts as a buffer to prevent the pressure from directly affecting the ink in the nozzle N. On the other hand, the ink suction recovery mechanism has a releasable cap KP which closes an end of the nozzle N. Under this condition, a lever RB for moving up and down a piston PN of a suction pump PN is pushed down to render a space AI2 in the suction pump PN to be at a negative pressure with respect to an atmospheric pressure so that the ink in the sub-tank ST is sucked into the suction pump PN through the supply tube T2, the nozzle N, the cap KP and the supply tube TP to recover the supply of the ink. The ink sucked into the suction pump PN drops to the bottom PNB of the pump through a valve BN and is ejected through an exhaust port HK.

In this ink suction recovery mechanism, when the lever RB is pushed down, the space AI2 in the pump PN reaches the negative pressure and tends to recover atmospheric pressure. As a result, the ink in the sub-tank ST is sucked into the pump PN through the supply tube T2, the nozzle N, the cap KP and the supply tube TP. As a result, a space AI1 in the sub-tank ST also reaches a negative pressure. Thereafter, the lever RB of the pump PN is returned to open the valve BN so that the space AI2 in the pump PN recovers the atmospheric pressure. At this moment, the pressure in the supply tube TP and the nozzle N in the cap KP, which are separated from the pump PN by the piston PST, remains negative and the pressure in the space AI1 in the sub-tank ST also remains negative. Accordingly, the ink in the sub-tank ST is pulled toward the nozzle N and the ink is sucked into the sub-tank ST by the main tank MT through the supply tube T1 because the pressure in the sub-tank ST is negative. By opening the cap KP when the ink has been supplied from the sub-tank ST into the nozzle N and the ink has been fully supplied from the main tank MT into the sub-tank ST and the pressures in the nozzle N and the space AI1 have recovered their original values, the ink in the nozzle N is properly held so that the printing is effected normally. However, if the cap KP is opened when the supply of the ink into the nozzle N and the sub-tank ST is insufficient and the negative pressure remain therein, air bubbles are introduced into the end of the nozzle N. It the printing is effected under this condition, the ink is not or imperfectly dischaged. Accordingly, a wait time is necessary until the pressures in the space AI1 in the sub-tank ST and the nozzle N recover the original values from the negative pressure conditions after the ink suction recovery operation so that a normal print condition is recovered. In the prior art printer, it is necessary that an operator count the wait time to determine when recovery is complete.

In the present embodiment, in order to avoid such an inconvenience, means is provided to indicate the progress of the wait time for the recovery after the suction recovery operation and the completion of the suction recovery operation in order to inform them to the operator.

Figure 2:
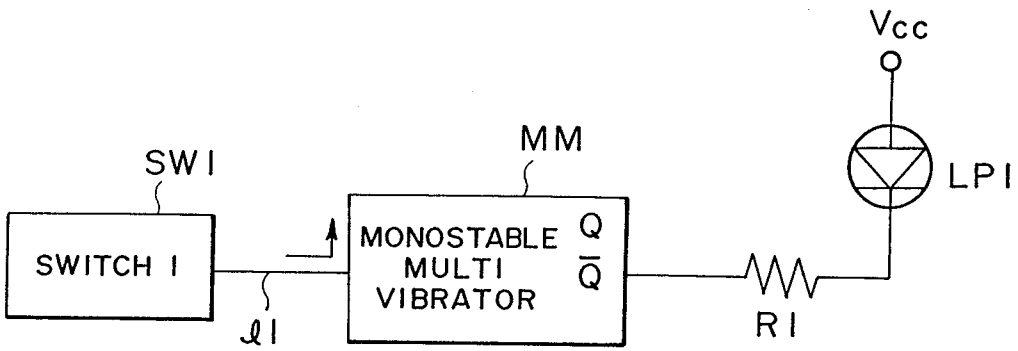
FIGS. 2, 3 and 4 show block diagrams of embodiments which indicate the suction recovery waiting time and the completion of the suction recovery operation by a lamp in the ink jet printer of the present invention.

Referring to FIG. 2, SW1 denotes a switch or detection means which has contacts S1 and S2 positioned to face the lever RB and the suction pump PN shown in FIG. 1, NM denotes a monostable multivibrator (one-shot), R1 denotes a resistor and LP1 denotes a lamp.

As explained above in connection with the suction recovery operation, when the lever RB of the pump PN is pushed down to the lowermost position after the nozzle N of the printer has been closed by the cap KP and the ink suction recovery operation has been ready, the contacts S1 and S2 contact so that the switch SW1 is closed. As a result, a signal supplied to the one-shot MM through a signal line l1 changes from "1" to "0". The one-shot MM is triggered by a positive-going signal so that it does not produce a signal at this moment. After the lever RB of the pump PN has been pushed down to the lowermost position and the ink in the sub-tank ST has been sucked through the nozzle N and the cap KP, the lever RB is returned to th original position, Thus, the contacts S1 and S2 are separated and the switch SW1 is opened. As a result, the signal supplied to the one-shot MM changes from "0" to "1" so that the one-shot MM is triggered by the positive-going signal to change an output signal at an output terminal $\overline{Q}$ changes from "1" to "0", a current flows into the lamp LP1 through the resistor R1 so that the lamp LP1 is lit to indicate the wait time for the suction recovery operation. After the predetermined time interval, the signal at the output terminal $\overline{Q}$ of the one-shot MM changes from "0" to "1" so that the lamp LP1 is turned off to indicate the completion of the recovery. If the signal at an output terminal Q of the one-shot MM is used to turn on and off the lamp LP1 the output signal is reversed and the lamp LP1 is turned on before the suction recovery operation, turned off during the wait time for the suction recovery operation, and again turned on after the completion of the suction recovery operation.

Figure 3:
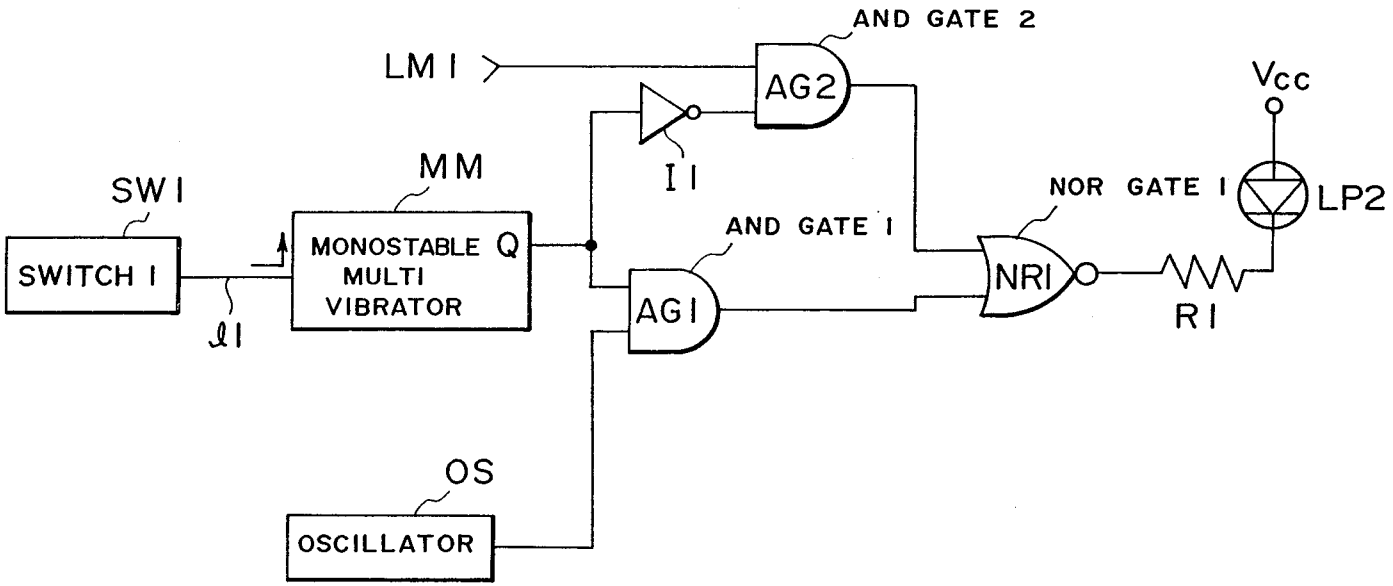

When it is desired to share a lamp used for another purpose in the printer with the lamp for the suction recovery operation in order to reduce a cost of the printer, a circuit as shown in FIG. 3 may be employed.

In the embodiment shown in FIG. 3, when the lever RB is returned after the suction recovery operation by the pump lever RB, the signal from the switch SW1 changes from "0" to "1" and the one-shot MM is triggered in the same manner to change the signal at the output terminal Q from "0" to "1". As a result, an AND gate AG1 which has been closed because the signal at the output terminal Q of the one-shot MM was "0" is opened to gate a signal from an oscillator OS. On the other hand, an AND gate AG2 which has passed a normal lamp signal LM1 is closed to produce an output "0". A NOR gate NR1 receives the outputs of the AND gate AG1 and AG2. Thus, in a normal state, a lamp LP2 is turned on and off by the normal lamp signal LM1, but when the suction recovery operation is in progress, the lamp LP2 is turned on and off by the signal from the oscillator OS. The lamp LP2 is an on-line lamp which is used to indicate to the operator that the printer is in a mode in which it receives print information from a host computer (not shown) and is ready to print when the printer is used as a terminal of the host computer. Thus, the lamp LP2 is turned on when the printer is connected to the host computer to receive the signal, but during the suction recovery operation, the normal lamp function is stopped for the predetermined time interval determined by the one-shot MM and the lamp LP2 is turned on and off by the pulses from the oscillator OS to indicate the waiting time after the suction recovery operation, and after the predetermined time interval, the normal lamp function is recovered and the completion of the suction recovery operation is indicated. In the present embodiment, when the ink jet printer is used as the terminal, the on-line lamp is shared with the recovery lamp. Instead of the on-line lamp, a power lamp which is turned on and off by a power switch may be used or any other indecation lamp may be used.

Where a plurality of lamps is used for normal purpose are included, those lamps may be sequentially turned on and off to indicate the suction recovery waiting time and the completion of the suction recovery operation to more clearly indicate the status in the suction recovery operation. An embodiment thereof is shown in FIG. 4.

Figure 4:
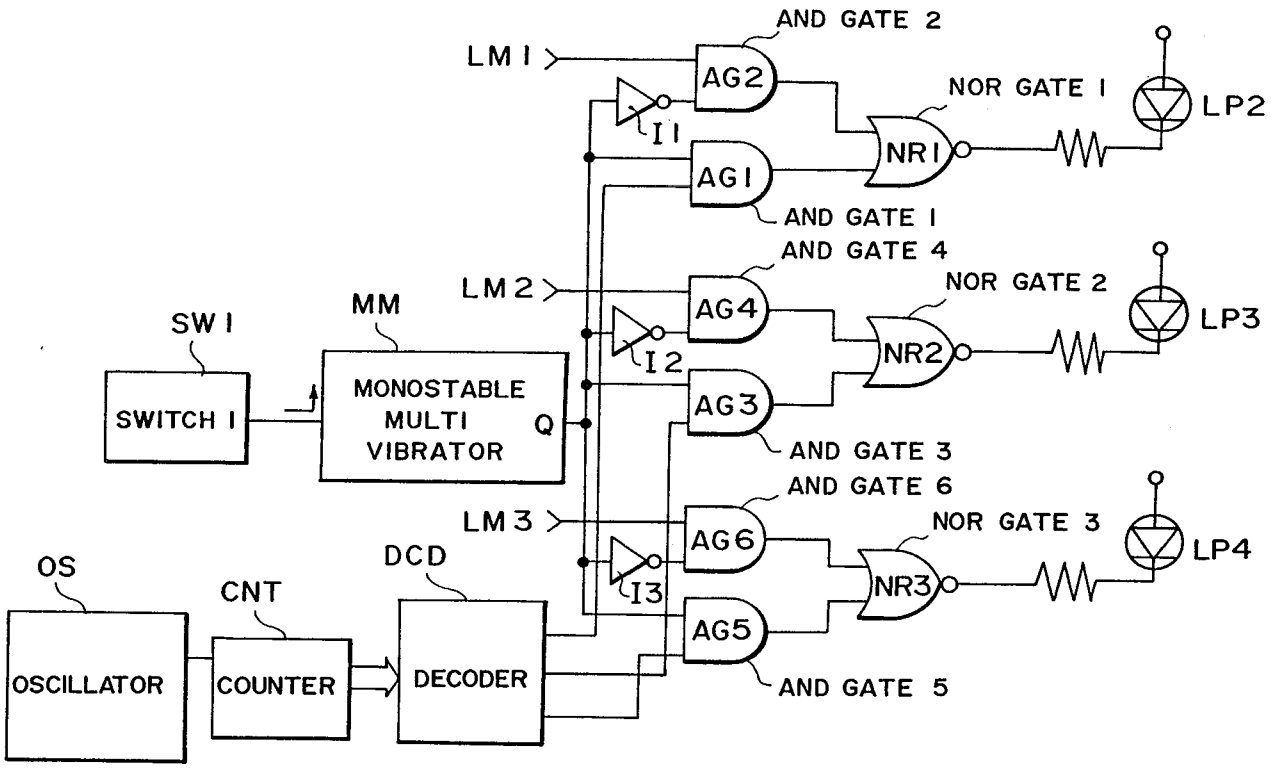

In one embodiment of FIG. 4, like the embodiment of FIG. 3, the one-shot MM is triggered by the positive-going signal (from "0" to "1") from the switch SW1, and when the output signal "1" is produced at the output terminal Q, normal lamp signals LM1, LM2 and LM3 are not produced from the AND gates AG2, AG4 and AG6 which are closed by the inverters I1, I2 and I3, respectively, and the lamps LP2, LP3 and LP4 are turned on and off through NOR gates NR1, NR2 and NR3 by signals from the AND gates AG1, AG3 and AG5 which are now opened. The lamp LP2 in the on-line lamp as is the case of the previous embodiment. The lamp LP3 is a ready lamp which indicates an on-status of the power supply of the printer, that is, a power supply on mode. The lamp LP4 is an alarm lamp which indicates a non-loaded state of record papers, for example, or a record disabled mode. Signals from a decoder DCD which receives an output of a counter which in turn receives the signal from the oscillator OS and decodes the counter output are supplied to the AND gates AG1, AG3 and AG5. Accordingly, at each output from the oscillator OS, the output from the decoder DCD changes and the output signals are sequentially supplied to the AND gates AG1, AG3 and AG5 so that the lamps LP2, LP3 and LP4 are sequentially turned on and off at the predetermined time interval during the waiting time after the suction recovery operation in order to indicate the waiting time. When the output of the one-shot MM terminates and the signal thereof changes from "1" to "0", the AND gates AG1, AG3 and AG5 are closed and the AND gates AG2, AG4 and AG6 are opened so that the lamps LP2, LP3 and LP4 are recovered to the original state to indicate the completion of the suction recovery operation.

Figure 5:
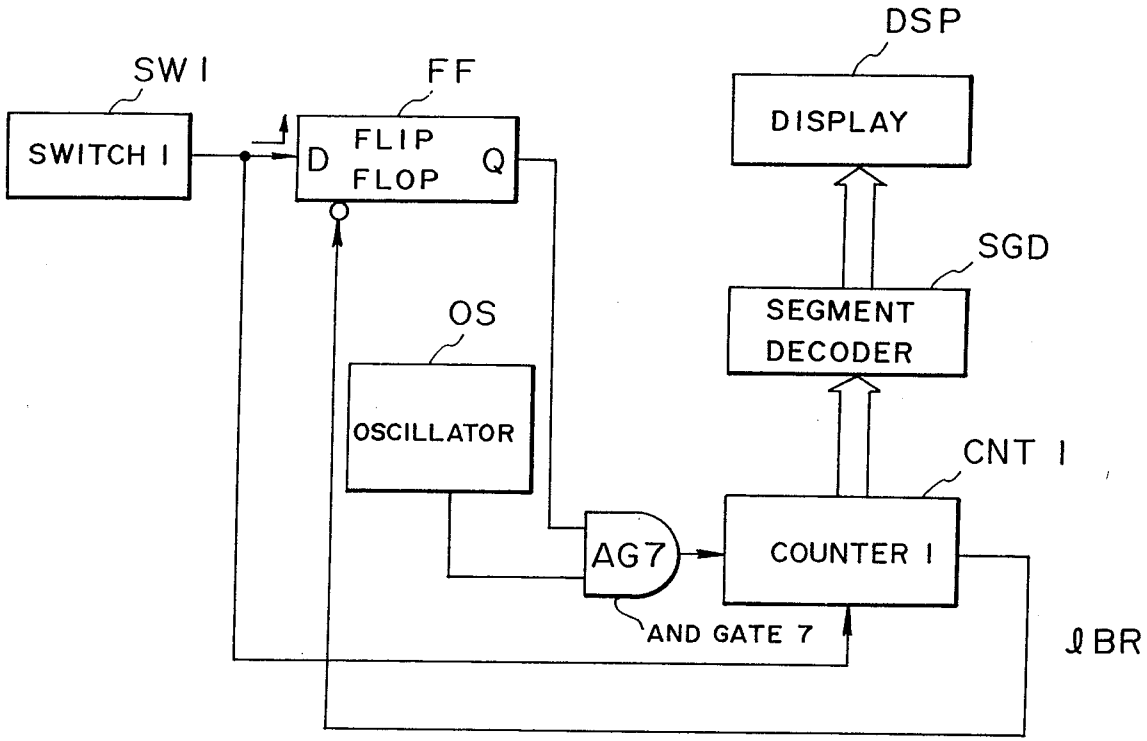
FIG. 5 shows a block diagram of another embodiment which numerically indicates the suction recovery waiting time and the completion of the suction recovery operation by an indicator.

An embodiment which indicates the waiting time after the suction recovery operation by sequentially changing a numeric value of a display is shown in FIG. 5. It is useful to indicate the recovery waiting time from time to time to display the progress. In the suction recovery operation, the lever RB is pushed down to contact the contacts S1 and S2. Thus, the output signal from the switch SW1 is changed from "1" to "0" and a counter CNT is initialized. As a result, an initial value from a segment decoder SGD is displayed on a display DSP. When the lever RB is returned so that the signal from the switch SW1 changes from "0" to "1", an output Q of a flip-flop FF which is set by a positive-going pulse changes from "0" to "1" and an AND gate AG7 is opened so that the output of the oscillator OS is supplied to an input of a count-down counter CNT1. If the initial value is 8, the display DSP initially displays "8", and at each pulse from the oscillator OS, the content of the count-down counter CNT1 changes to 7, 6, 5, . . . and the content of the display DSP changes accordingly. As the counting proceeds, the count-down counter CNT1 finally produces a borrow output on a signal line lBR. The flip-flop FF is reset by the borrow output so that the AND gate AG7 is closed and the operation of the count-down counter CNT1 is stopped. Thus, the display DSP stops at the "0" state to indicate the end of the waiting time for the suction recovery operation and the completion of the recovery. If a pulse interval of the oscillator OS is one second, the recovery waiting time of eight seconds is displayed. When the count-down counter CNT1 is replaced by a count-up counter and a coincidence circuit is provided to produce a signal similar to the borrow output at a predetermined count, the recovery waiting time is defined by a time to reach the predetermined count and when the predetermined count is reached, the completion of the recovery can be indicated.

In the above embodiment, the recovery waiting time is determined by the time duration of the one-shot MM and the pulse width of the oscillator OS and the count thereof. The recovery waiting time after the suction recovery operation is equal to a time period from the end of the suction recovery operation to a time when the negative pressure in the nozzle N and the negative pressure in the sub-tank ST recover the original pressures and it has been experimentarily proved that the recovery waiting time is approximately ten seconds. Thus, the time duration of the one-shot MM, the pulse width of the oscillator OS and the count may be set in accordance with this value.

If the NOR gates in the embodiments of FIGS. 3 and 4 are replaced by OR gates, the turn-on and turn-off of the lamps are reversed. A buzzer may be used instead of the lamp to inform the recovery waiting time and the completion of the recovery by a buzzer sound.

In the above embodiment, the completion of the suction recovery operation is determined by the counting by the timer. Alternatively, the pressure in the cap KP may be measured so that the completion of the suction recovery time is indicated when the pressure increases above a predetermined level.

What I claim is:

1. An ink jet printer comprising:
a recording head for discharging ink from an end of thereof;
capping means for releasably sealing said end of said recording head;
suction means connected to said capping means for sucking said end of said recording head through said capping means by producing a negative pressure;
detection means associated with said suction means for detecting the sucking operating of said suction means; and
indication means for providing an indication that the sucking operation of said suction means is in progress on the basis of detecting signal from said detection means, and terminating the indication when the pressure at said end of said recording head reaches a predetermined level.

2. An ink jet printer according to claim 1, wherein said indication means includes timer means adapted to be turned on by a detection signal from said detection means and turned off after a predetermined time period.

3. An ink jet printer according to claim 1, wherein said indication means includes gate means for indicating the sucking operation of said suction means by a lamp for indicating an operation mode of said ink jet printer.

4. An ink jet printer according to claim 1, wherein said indication means comrises a plurality of indication lamps for indicating operation modes of said ink jet printer and gate means for selectively turning on and off said plurality of indication lamps in accordance with the progress of the sucking operation of said suction means.

5. An ink jet printer according to claim 1, wherein said indication means includes display means for character-displaying a time required for the completion of the operation of said suction means.

6. An ink jet printer comprising:
a recording head for discharging ink from an end thereof;
capping means for releasably sealing said end of said recording head;
suction means connected to said capping means operable for sucking said end of said recording head through said capping means by producing a negative pressure; and
signal generating means associated with said suction means, including timer means for counting time from the start of operation of said suction means until a predetermined time period has passed to allow for pressure recovery at said end of said recording head, for generating a signal for indicating that said capping means is not to be separated from said recording means from the start of said suction means operation until the lapse of the predetermined time period.

7. An ink jet printer comprising:
a recording head for discharging ink from an end thereof;
cover means for detachably covering said end of said recording head;
elimination means connected to said cover means for eliminating blockage of said recording head by providing a negative pressure at said end of said recording head; and
indicating means associated with said blockage elimination means for indicating whether or not said ink jet printer may effect recording, by means of a first mode, and for indicating that said blockage elimination means is operating for a predetermined time to allow pressure recovery at said end of said recording head when said blockage elimination means is in operation, by means of a second mode.

8. An ink jet printer according to claim 7, wherein said indication means operates in said first mode by one of continuously emitting light and emitting no light, and in said second mode by emitting light intermittently.

9. An ink jet printer comprising:
a recording head for discharging ink from an end thereof;
cover means for detachably covering said end of said recording head;
elimination means connected to said cover means for eliminating blockage of said recording head by providing a negative pressure at said end of said recording head; and
indication means associated with said blockage elimination means for indicating a plurality of states of said ink jet printer by means of a first mode, and for indicating how long the operation of said blockage elimination means will still last to allow pressure recovery at said end of said recording head when said blockage elimination means is in operation by means of a second mode.

10. An ink jet printer according to claim 9, wherein said indicating means operates in said first mode by continuously emitting light and in said second mode by emitting flashing light repeatedly.

11. An ink jet printer according to claim 10, wherein said indication means comprises a plurality of lamps.

* * * * *

UNITED STATES PATENT AND TRADEMARK OFFICE

CERTIFICATE OF CORRECTION

PATENT NO. : 4,518,973

DATED : May 21, 1985

INVENTOR(S) : SHIGEMITSU TAZAKI

It is certified that error appears in the above-identified patent and that said Letters Patent is hereby corrected as shown below:

Column 1, line 35, delete "a";
line 66, change "becouse" to --because--.

Column 2, line 26, change "PN" to --PST--;
line 37, change "by" to --from--;
line 50, change "It" to --If--;
line 52, change "dischaged" to --discharged--.

Column 3, line 16, change "position," to --position.--;
line 37, change "a" to --the--.

Column 4, line 6, change "indecat ion" to --indication--;
line 24, change "is" to --in--.

Column 5, line 31, change "inform" to --indicate--;
line 67, change "comrises" to --comprises--.

Signed and Sealed this

*Twenty-fifth* Day of *March 1986*

[SEAL]

*Attest:*

DONALD J. QUIGG

*Attesting Officer*

*Commissioner of Patents and Trademarks*